US010415301B2

(12) United States Patent
Kuan

(10) Patent No.: US 10,415,301 B2
(45) Date of Patent: Sep. 17, 2019

(54) AUTOMATIC RELEASED FOLDABLE DOOR HAVING TWO-WAY DOOR STRUCTURE

(71) Applicant: Hsing-hua Kuan, Taipei (TW)

(72) Inventor: Hsing-hua Kuan, Taipei (TW)

( * ) Notice: Subject to any disclaimer, the term of this patent is extended or adjusted under 35 U.S.C. 154(b) by 214 days.

(21) Appl. No.: 15/534,485

(22) PCT Filed: Feb. 11, 2015

(86) PCT No.: PCT/CN2015/072721

§ 371 (c)(1),
(2) Date: Jun. 9, 2017

(87) PCT Pub. No.: WO2016/127326

PCT Pub. Date: Aug. 18, 2016

(65) Prior Publication Data

US 2017/0350185 A1 Dec. 7, 2017

(51) Int. Cl.

| | |
|---|---|
| ***E06B 3/48*** | (2006.01) |
| ***E05B 65/06*** | (2006.01) |
| ***E05C 1/06*** | (2006.01) |
| ***E05C 7/02*** | (2006.01) |
| ***E05C 19/16*** | (2006.01) |
| ***E05D 15/26*** | (2006.01) |

(Continued)

(52) U.S. Cl.

CPC ..... *E06B 3/481* (2013.01); *E05B 65/0085* (2013.01); *E05B 65/06* (2013.01); *E05C 1/065* (2013.01); *E05C 7/02* (2013.01); *E05C 7/045* (2013.01); *E05C 17/56* (2013.01); *E05C 19/168* (2013.01); *E05D 15/26* (2013.01); *E05D 15/264* (2013.01); *E05D 15/48* (2013.01); *E06B 3/48* (2013.01); *E06B 3/485* (2013.01); *E06B 7/32* (2013.01); *E05F 1/00* (2013.01); *E05Y 2900/132* (2013.01); *E06B 2003/346* (2013.01); *E06B 2003/7057* (2013.01)

(58) Field of Classification Search

CPC ..... E06B 3/481

See application file for complete search history.

(56) References Cited

U.S. PATENT DOCUMENTS

| | | | |
|---|---|---|---|
| 712,449 A | 10/1902 | Young | |
| 1,581,776 A | 4/1926 | Altschul | |

(Continued)

FOREIGN PATENT DOCUMENTS

| | | | |
|---|---|---|---|
| CN | 201321795 Y * | 10/2009 | |
| DE | 9203230 U1 * | 5/1992 | ..... A47K 3/36 |

OTHER PUBLICATIONS

Machine translation of CN201321795Y.*

*Primary Examiner* — Marcus Menezes
(74) *Attorney, Agent, or Firm* — Chun-Ming Shih

(57) ABSTRACT

Disclosed is an automatic released foldable door having a two-way door structure, which foldable door comprises a first closing door device (11) and a second closing door device (13), wherein a first door leaf (2) is connected to one side of the first closing door device (11), the second closing door device has one side connected to the first door leaf (2) and the other side thereof connected to a second door leaf (6), the second door leaf (6) is a door-in-door and a two-way door structure; and the foldable door further comprises a plurality of fixing devices (3, 31, 7) and at least one hinge (4). The foldable door has a relatively small turning radius and can be folded for receiving, and the door-in-door can be rotated in different directions.

13 Claims, 11 Drawing Sheets

(51) Int. Cl.

| | |
|---|---|
| ***E06B 7/32*** | (2006.01) |
| ***E05B 65/00*** | (2006.01) |
| ***E05C 17/56*** | (2006.01) |
| ***E05C 7/04*** | (2006.01) |
| ***E05D 15/48*** | (2006.01) |
| *E06B 3/34* | (2006.01) |
| *E06B 3/70* | (2006.01) |
| *E05F 1/00* | (2006.01) |

(56) References Cited

U.S. PATENT DOCUMENTS

| | | | | |
|---|---|---|---|---|
| 1,934,546 | A | 11/1933 | Lewerentz | |
| 2,929,445 | A * | 3/1960 | Haws | E04B 2/827 160/188 |
| 4,389,817 | A | 6/1983 | Olberding | |
| 4,583,262 | A | 4/1986 | Werner | |
| 5,392,834 | A * | 2/1995 | Borgardt | E06B 3/481 160/118 |
| 5,429,399 | A * | 7/1995 | Geringer | E05B 41/00 292/251.5 |
| 5,535,550 | A * | 7/1996 | Yang | E05B 65/1053 292/92 |
| 6,526,694 | B1 | 3/2003 | Cosgrove | |
| 9,051,766 | B2 * | 6/2015 | Kuan | E05D 15/54 |
| 2010/0162523 | A1 * | 7/2010 | Ferguson | E05C 17/56 16/82 |
| 2010/0230979 | A1 * | 9/2010 | Gries | E05C 19/16 292/251.5 |
| 2013/0000203 | A1 * | 1/2013 | Platt | E05D 3/08 49/246 |
| 2014/0047771 | A1 | 2/2014 | Kuan | |
| 2017/0202403 | A1 * | 7/2017 | Dozois | A47K 3/362 |
| 2018/0209206 | A1 * | 7/2018 | Castaldi, III | E06B 3/481 |

* cited by examiner

AUTOMATIC RELEASED FOLDABLE DOOR HAVING TWO-WAY DOOR STRUCTURE

BACKGROUND OF THE INVENTION

1. Field of the Invention

The present invention relates to large width normally open door technology and more particularly, to an Automatic released foldable door having two-way door structure that has a sub hinging door leaf mounted in one of multiple hinging door leafs.

2. Description of the Related Art

The large width access doors of modern building are commonly divided into the two categories of normally open type and normally close type. A normally close type large width access door is normally equipped with a lock to maintain access control. A normally open type large width access door is normally opened through 90 degrees or 180 degrees and secured in the open position by an electromagnetic buckle for free staff access in normal condition. In case of emergency, the emergency electromagnetic buckle is unlocked, allowing the door leaf to be moved back to the close position by a closing door device to protect against fire or smoke.

The fire safety regulations of most countries around the world emphasize that the performance of the automatic door-closing mechanism in emergency situations should be ensured. However, the building safety management units of various countries around the world have discovered that the radius of gyration, return travel and moving direction of the door leaf of a large width access door, especially the access door in a walkway, can hinder or even injure the evacuees.

SUMMARY OF THE INVENTION

The present invention has been accomplished under the circumstances in view. It is one object of the present invention to provide an Automatic released foldable door having two-way door structure, which has a small radius of gyration and amplitude and, which is practical for use in an emergency shelter or a narrow walkway or space without hindering the movement of people in case of emergency.

To achieve this and other objects of the present invention, an Automatic released foldable door having two-way door structure comprises a first closing door means; a first door leaf connected to one side of the first closing door means, the first door leaf comprising a top edge, an outer edge vertically downwardly extended from one end of the top edge and a mounting hole vertically downwardly extended from the top edge; a first fixing device mounted at one side of the first door leaf; a first micro switch mounted at the top edge and electrically connected to the first fixing device; a locking latch mounted in the mounting hole of the first door leaf; a second door leaf; a second fixing device mounted at one side of the second door leaf corresponding to the first fixing device and detachably connectable with the first fixing device; a third fixing device mounted at an opposite side of the second door leaf; at least one first hinge having one hinge leaf thereof affixed to the first door leaf and an opposite hinge leaf thereof affixed to the second door leaf; and a second closing door means having one end thereof connected to the first door leaf and an opposite side thereof connected to the second door leaf.

Preferably, the locking latch comprises a touch pressure device, an elastic latch rod and a control knob. The touch pressure device comprises a receiving hole. The control knob is mounted at the outer edge of the first door leaf. The elastic latch rod is inserted into the mounting hole with one end thereof movable in and out of the receiving hole of the touch pressure device. The touch pressure device is mounted in a top side of the mounting hole and touchable by the door frame to release the elastic latch rod for allowing the elastic latch rod to extend its one end out of the mounting hole. The control knob is operable by an external force to move the elastic latch rod into a retracted position where the one end of the elastic latch rod is received inside the mounting hole.

Preferably, the first fixing device comprises a lock hole, a control circuit and a power supply. The control circuit, the power supply and the lock hole are electrically coupled together. The second fixing device is lockable to and releasable by the lock hole subject to the control of the control circuit. Further, the third fixing device is an electromagnetic buckle. The fourth fixing device is a ferrous metal affixed to an external surrounding wall to face toward the electromagnetic buckle and adapted for releasably catching the electromagnetic buckle.

Preferably, the Automatic released foldable door having two-way door structure further comprises a first door frame, wherein the first closing door means has an opposite side thereof connected to the first door frame.

Preferably, the Automatic released foldable door having two-way door structure further comprises an electric control switch and a fourth fixing device. The fourth fixing device is mounted at a wall at one lateral side of the door frame to face toward the third fixing device. The electric control switch is electrically coupled with the fourth fixing device, and adapted for controlling the fourth fixing device to release the third fixing device.

Preferably, the control knob is manually operable to retract the elastic latch rod into the inside of the mounting hole, for allowing the first door leaf and the second door leaf to be folded up and received to a surrounding wall at one lateral side of the first door leaf where the third fixing device is locked to the fourth fixing device.

Preferably, the first door leaf or the second door leaf is a two-way door design.

In one embodiment of the present invention, the second door leaf comprises a second door frame, a second hinge, a third door leaf and a third closing door means. The second door frame is an open frame. The second hinge has one hinge leaf thereof affixed to the second door frame, and an opposite hinge leaf thereof affixed to the third door leaf. The third closing door means has one side thereof connected to a top edge of the second door frame, and an opposite side thereof connected to a top side of the third door leaf. The third door leaf is openable relative to the first door frame when the second door leaf is closed and locked to the first door frame.

Further, the first closing door means, the second closing door means and the third closing door means are closing door devices (i.e., the first closing door device, the second closing door device, the third closing door device) that provide a damping resistance to buffer the closing speed of the connected door leaf.

In the embodiments of the present invention, the invention divide the large width normally open door into multiple door leafs, for example, a first door leaf and a second door leaf that have a relatively smaller radius of gyration and amplitude and can be folded up and received to one lateral surrounding wall. Further, multiple fixing devices are used with the multiple door leafs for locking the respective door leafs in a releasable manner so that the Automatic released foldable door having two-way door structure can effectively achieve the expected isolation function in case of emergency.

When compared with conventional large width normally open door designs, the invention is more practical for use in an emergency shelter or a narrow walkway or space for the advantages of relatively smaller radius of gyration and amplitude, free personnel movements without hindering, and high reliability in large width access gate auto-closing performance.

Other advantages and features of the present invention will be fully understood by reference to the following specification in junction with the accompanying drawings, in which like reference signs denote like components of structure.

DETAILED DESCRIPTION OF THE PREFERRED EMBODIMENT

Figure 1:
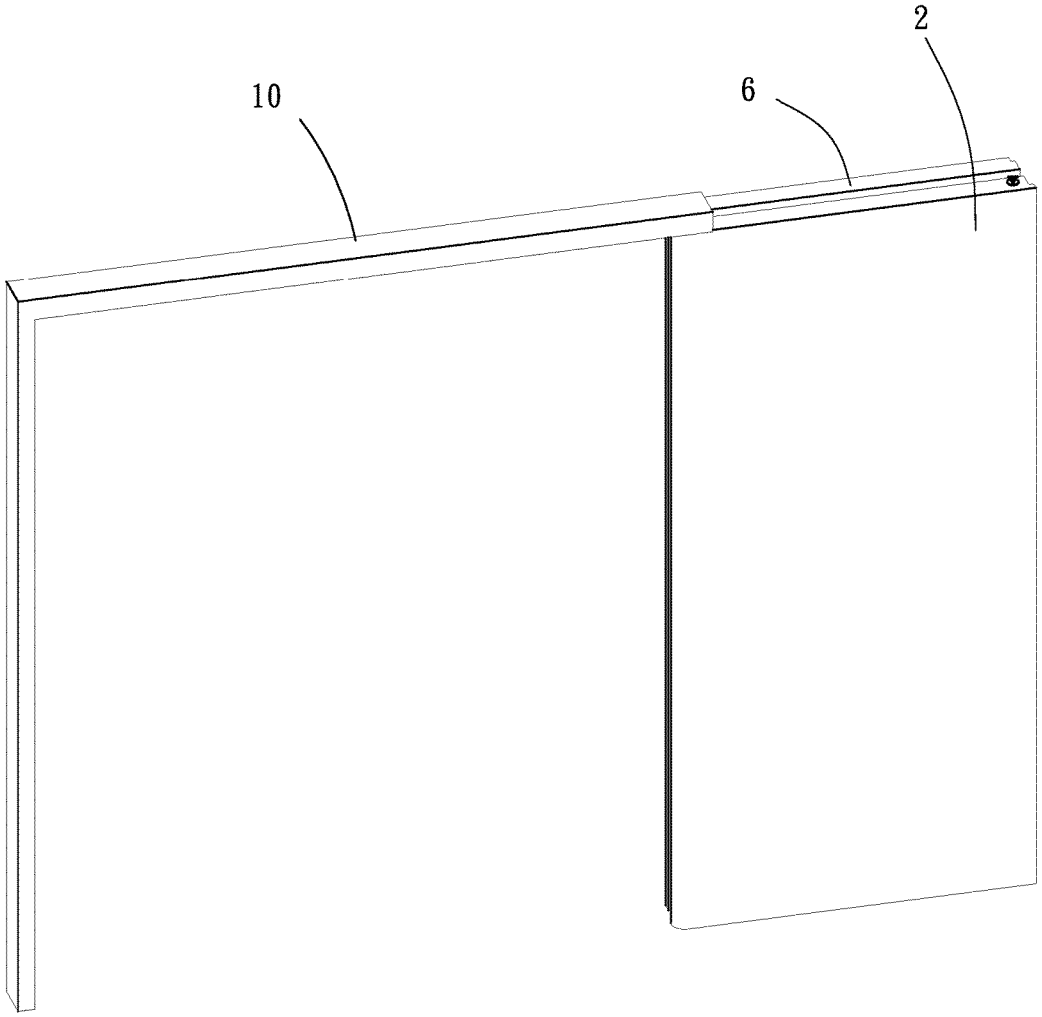
FIG. 1 is an oblique top elevational view of an Automatic released foldable door having two-way door structure in accordance with the present invention.
Figure 2:
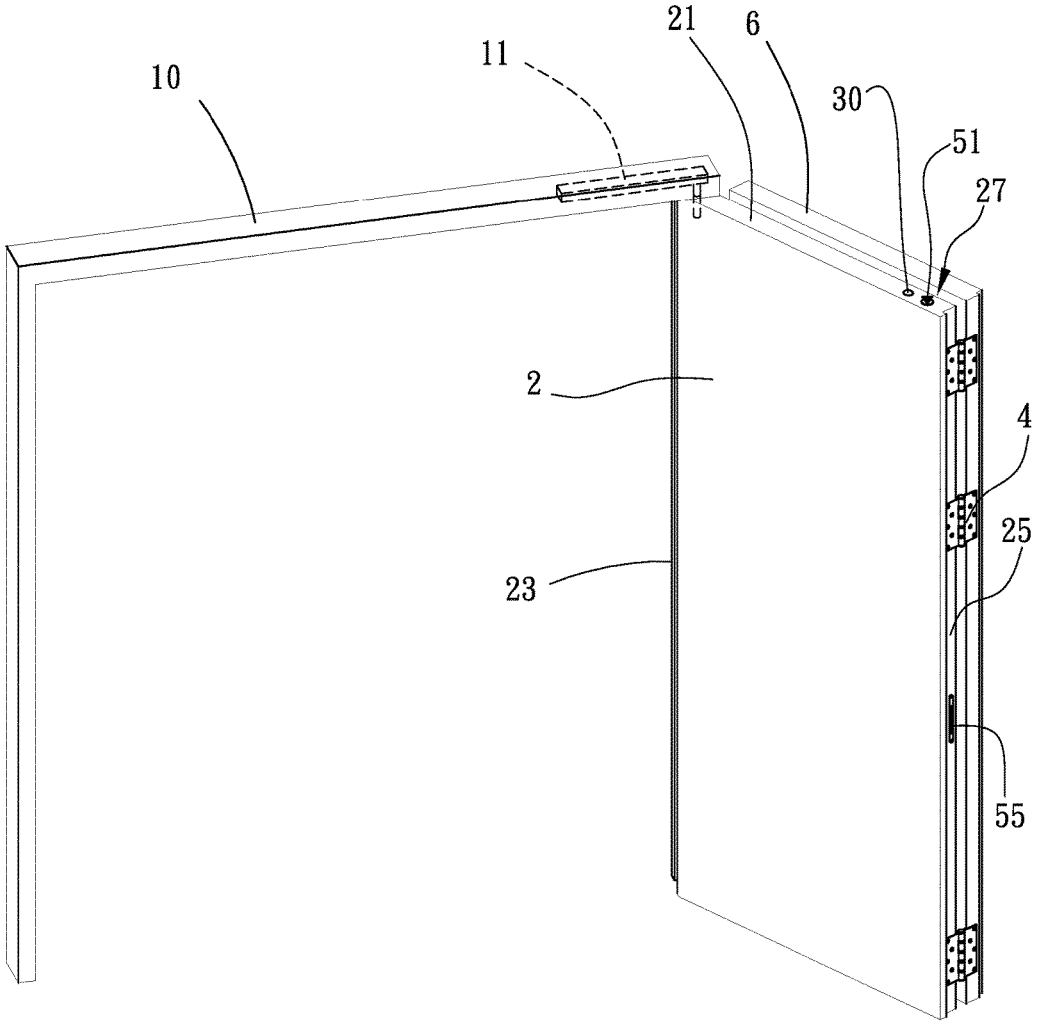
FIG. 2 is a schematic drawing of the present invention illustrating an folding operation of the first door leaf and the second door leaf.

Referring to FIGS. 1-5, an Automatic released foldable door having two-way door structure in accordance with the present invention is shown. The Automatic released foldable door having two-way door structure comprises a first closing door means, i.e., first closing door device 11; a first door leaf 2 connected to one side of the first closing door device 11 and comprising a top edge 21, an outer edge 25 vertically downwardly extended from an outer end of the top edge 21 and a mounting hole 27 located on and downwardly extended from the top edge 21; a first fixing device 3 fixedly mounted at one side of the first door leaf 2; a first micro switch 30 mounted at the top edge 21 and connected to the first fixing device 3; a locking latch 5 mounted in the mounting hole 27 of the first door leaf 2; a second door leaf 6; a second fixing device 31 affixed to one side of the second door leaf 6 corresponding to the first fixing device 3; a third fixing device 7 affixed to an opposite side of the second door leaf 6; at least one first hinge 4 with one hinge leaf thereof affixed to the first door leaf 2 and an opposite hinge leaf thereof affixed to the second door leaf 6; and a second closing door means, i.e., second closing door device 13 with one side thereof affixed to the first door leaf 2 and an opposite side thereof affixed to the second door leaf 6.

Figure 3:
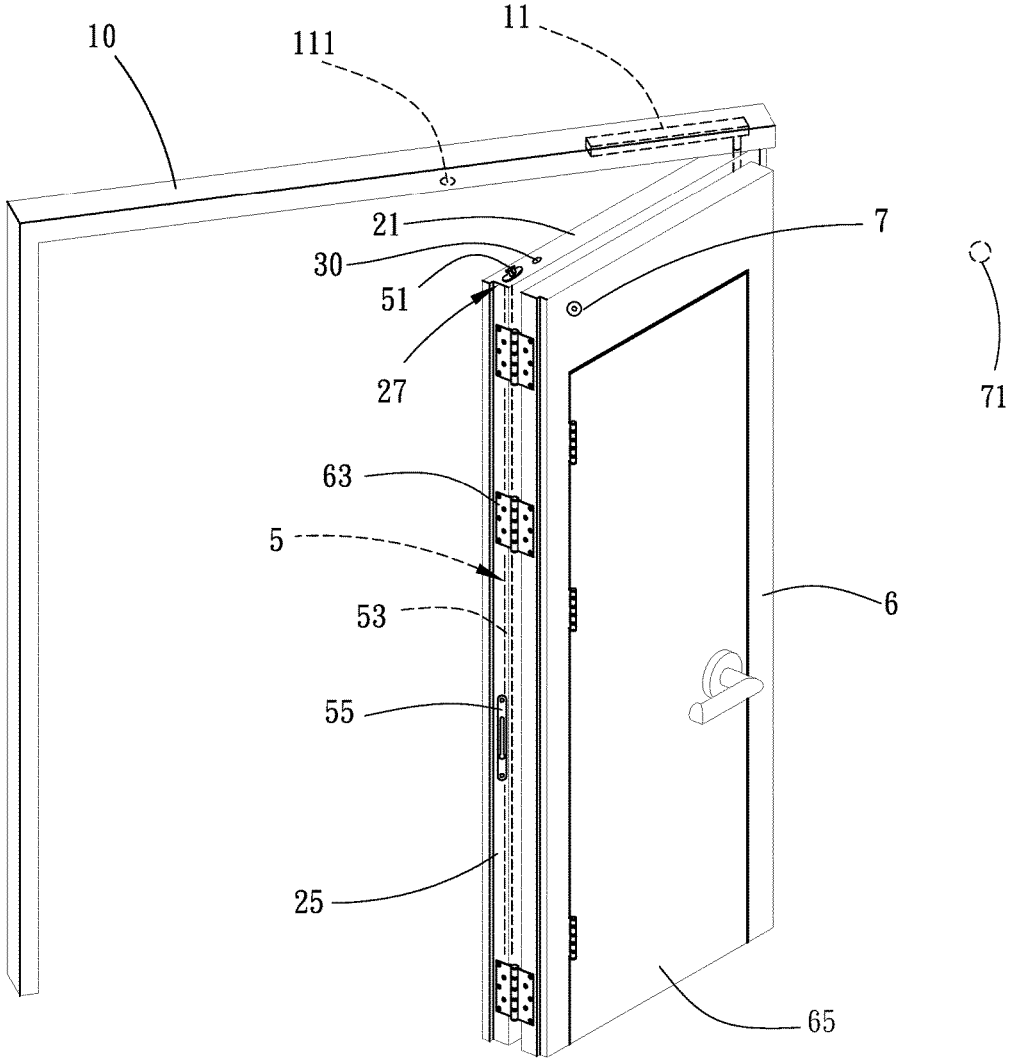
FIG. 3 is a schematic drawing of the present invention illustrating another folding operation of the first door leaf and the second door leaf.
Figure 3A:
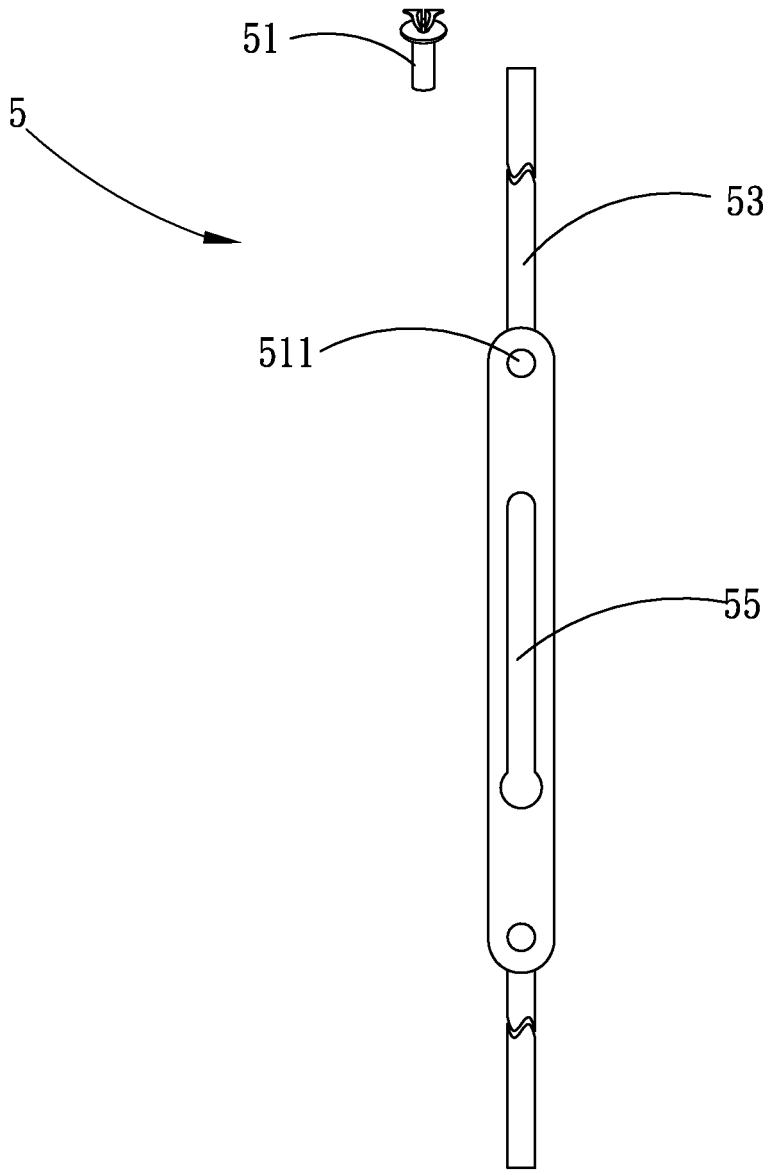
FIG. 3A is a schematic drawing illustrating the structure of the locking latch control knob.
Figure 4:
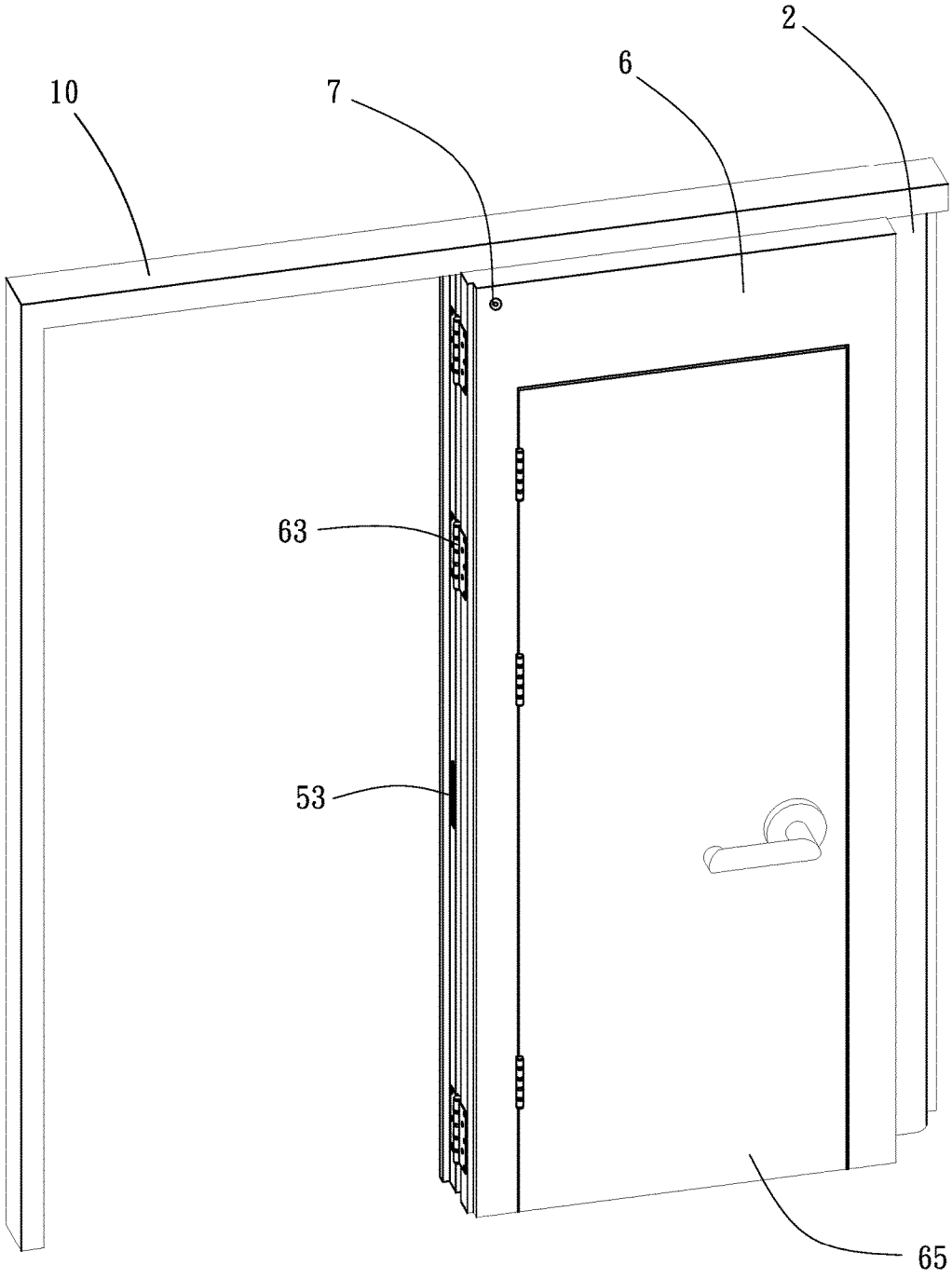
FIG. 4 is a schematic drawing illustrating the first door leaf and the second door leaf received together under the door frame.

Referring also to FIG. 3A and FIG. 3, in the present preferred embodiment, the locking latch 5 comprises a touch pressure device 51, an elastic latch rod 53 and a control knob 55. The touch pressure device 51 defines therein a receiving hole 511. The control knob 55 is located on the outer edge 25. The elastic latch rod 53 is mounted in the mounting hole 27, having one end thereof axially slidably inserted into the receiving hole 511 of the touch pressure device 51. The touch pressure device 51 is coupled to the mounting hole 27 for touching the door frame to release the elastic latch rod 53 so that the elastic latch rod 53 can extend its one end out of the mounting hole 27. On the contrary, the control knob 55 can be pulled to move the elastic latch rod 53, causing retraction of the one end of the elastic latch rod 53 into the inside of the mounting hole 27.

Referring also to FIGS. 6-9, the Automatic released foldable door having two-way door structure is mounted in a first door frame 10.

The first door leaf 2 is connected to one side of first closing door device 11. The first closing door device 11 has an opposite side thereof connected to the first door frame 10. In the present preferred embodiment, the first door frame 10 comprises a first locating hole 111 in a bottom side of a top rail thereof. The first closing door device 11 is fastened to the top rail of the first door frame 10. The present invention further comprises an electric control switch (not shown), and a fourth fixing device 71 mounted at a surrounding wall around the door frame to face toward the third fixing device 7. The electric control switch is electrically connected with the fourth fixing device 71 and adapted for controlling the operation of the fourth fixing device 71. Actually, the electric control switch can be selectively mounted at the folding door, the door frame, or the wall surrounding the door frame. Triggering the electric control switch can drive the fourth fixing device 71 to release the third fixing device 7, allowing the second door leaf 6 and the first door leaf 2 to be biased to the bottom side of the first door frame 10 where the touch pressure device 51 that protrudes over the mounting hole 27 is triggered by the top rail of the first door frame 10 to release the elastic latch rod 53 so that the elastic latch rod 53 can be extended out and engaged into the first locating hole 111 of the first door frame 10 to lock the first door leaf 2 to the first door frame 10. At the same time, the micro switch 30 is triggered by the first door frame 10 to give an electric signal to the first fixing device 3, causing the first fixing device 3 to release the second fixing device 31, and thus the first closing door device 11 can bias the second door leaf 6 relative to the first door leaf 2 through 180° angle to fully close the folding door.

The elastic latch rod 53 is elastically retractably extended out to engage into the first locating hole 111 in the top rail of the first door frame 10 to lock the first door leaf 2. When the user wishes to open the folding door, pull the control knob 55 to drive the elastic latch rod 53, retracting the elastic latch rod 53 from the first locating hole 111 into the inside of the mounting hole 27, for allowing the first door leaf 2 and the second door leaf 6 to be folded up and received to the wall surface at one lateral side of the first door leaf 10.

In the present preferred embodiment, the first closing door device 11 or the second closing door device 13 is commercially available common mechanical device that closes a door after someone opens it. The first closing door device 11 or the second closing door device 13 can be mounted between two door leafs, or between one door leaf and the door frame subject to the direction of power required for automatically closing the door leaf. In this embodiment, the first closing door device 11 is mounted between the first door leaf 2 and the door frame 10 to minimize the door gap so as to prevent channeling of fluid or smoke when the door is completely closed; the second closing door device 13 is mounted between the first door leaf 2 and the second door leaf 6 to buffer the closing speed of the second door leaf 6, avoiding hurting people due to fast closing speed.

The first fixing device 3 can be, for example, an electromagnetic buckle, the third fixing device 7 can be a ferrous metal attractive to the electromagnetic buckle.

Figure 5:
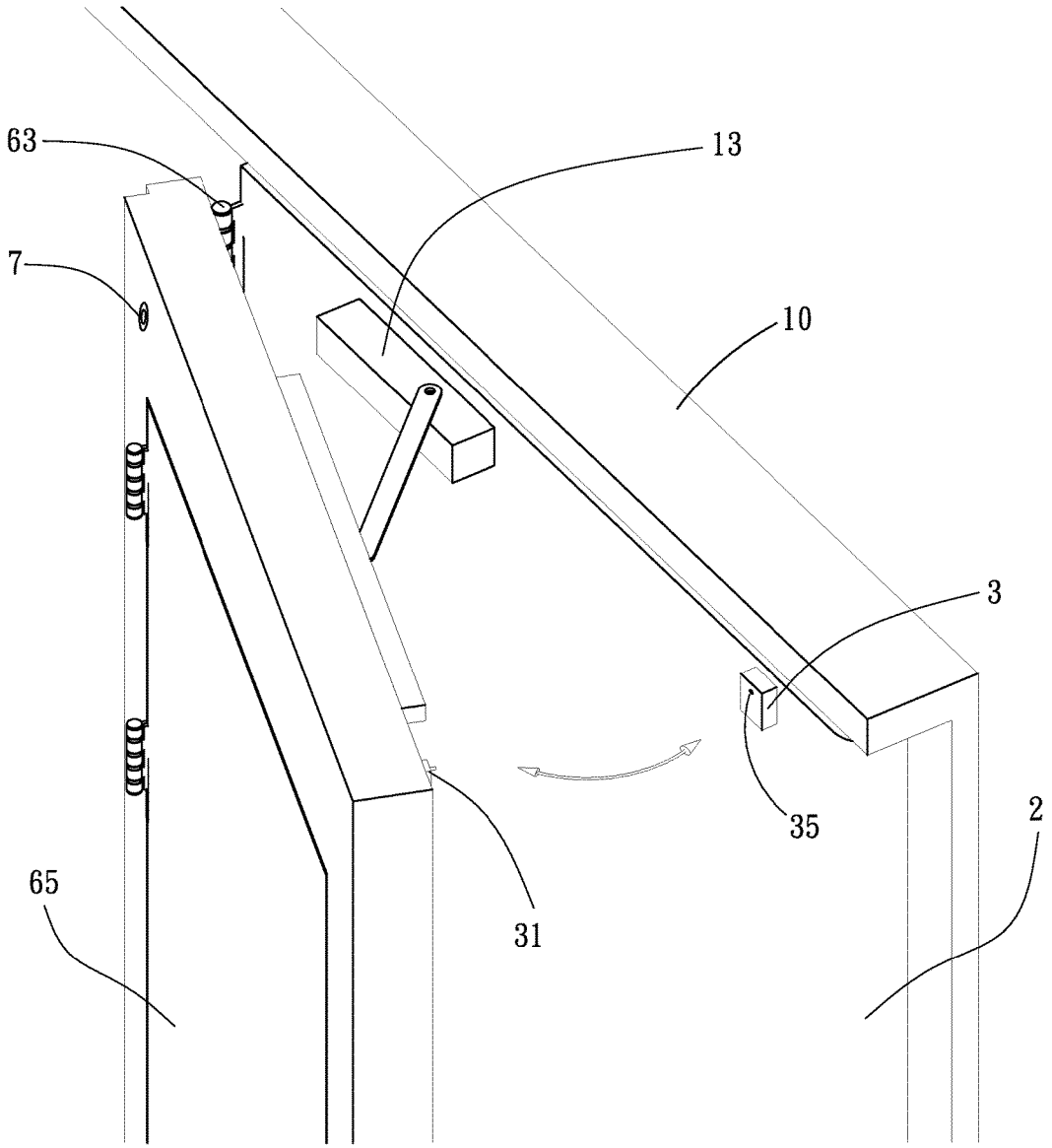
FIG. 5 illustrates the arrangement of the second closing door device between the first door leaf and the second door leaf.
Figure 6:
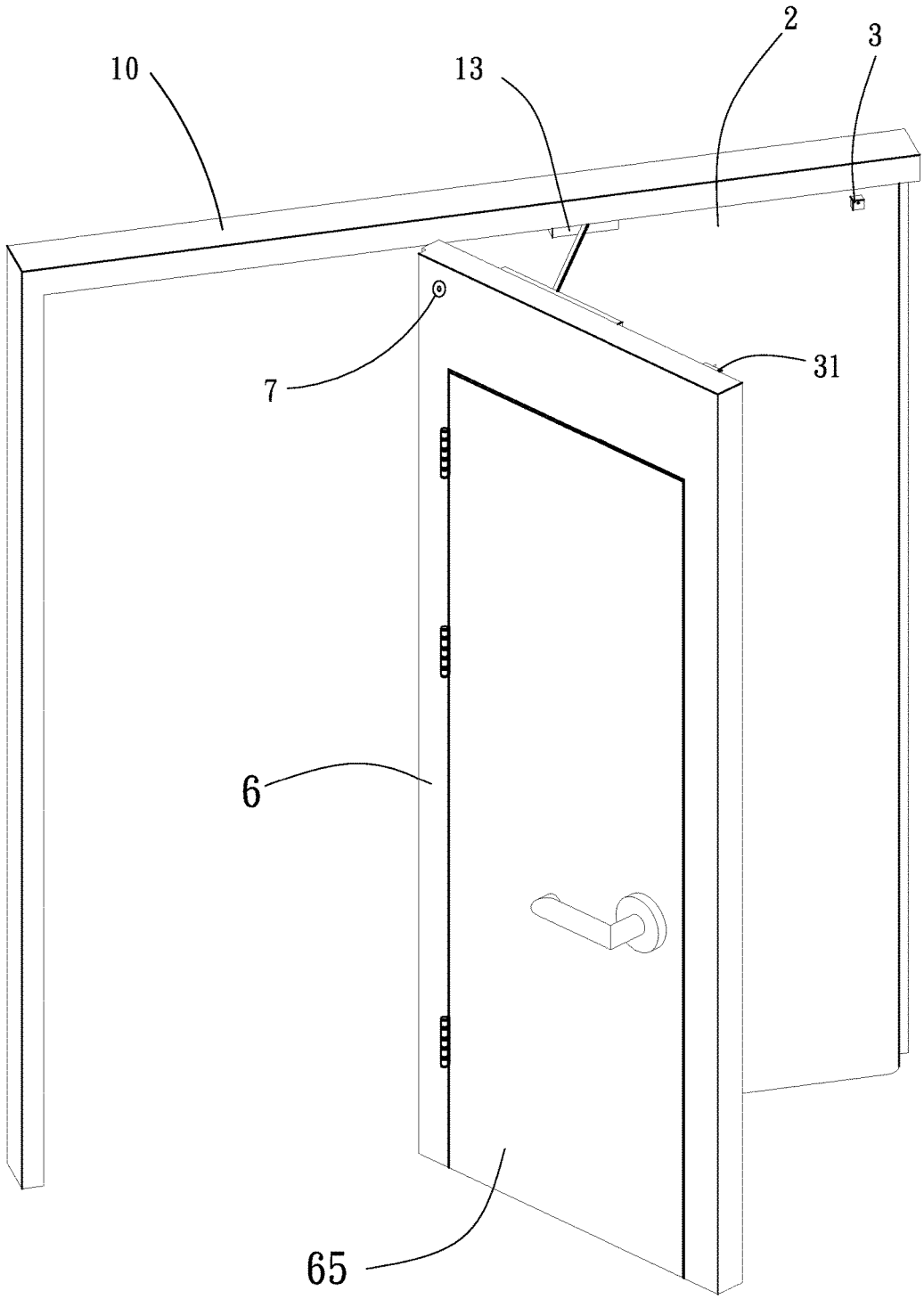
FIG. 6 is a schematic operational view of the present invention, illustrating the second door leaf opened from the first door leaf.
Figure 7:
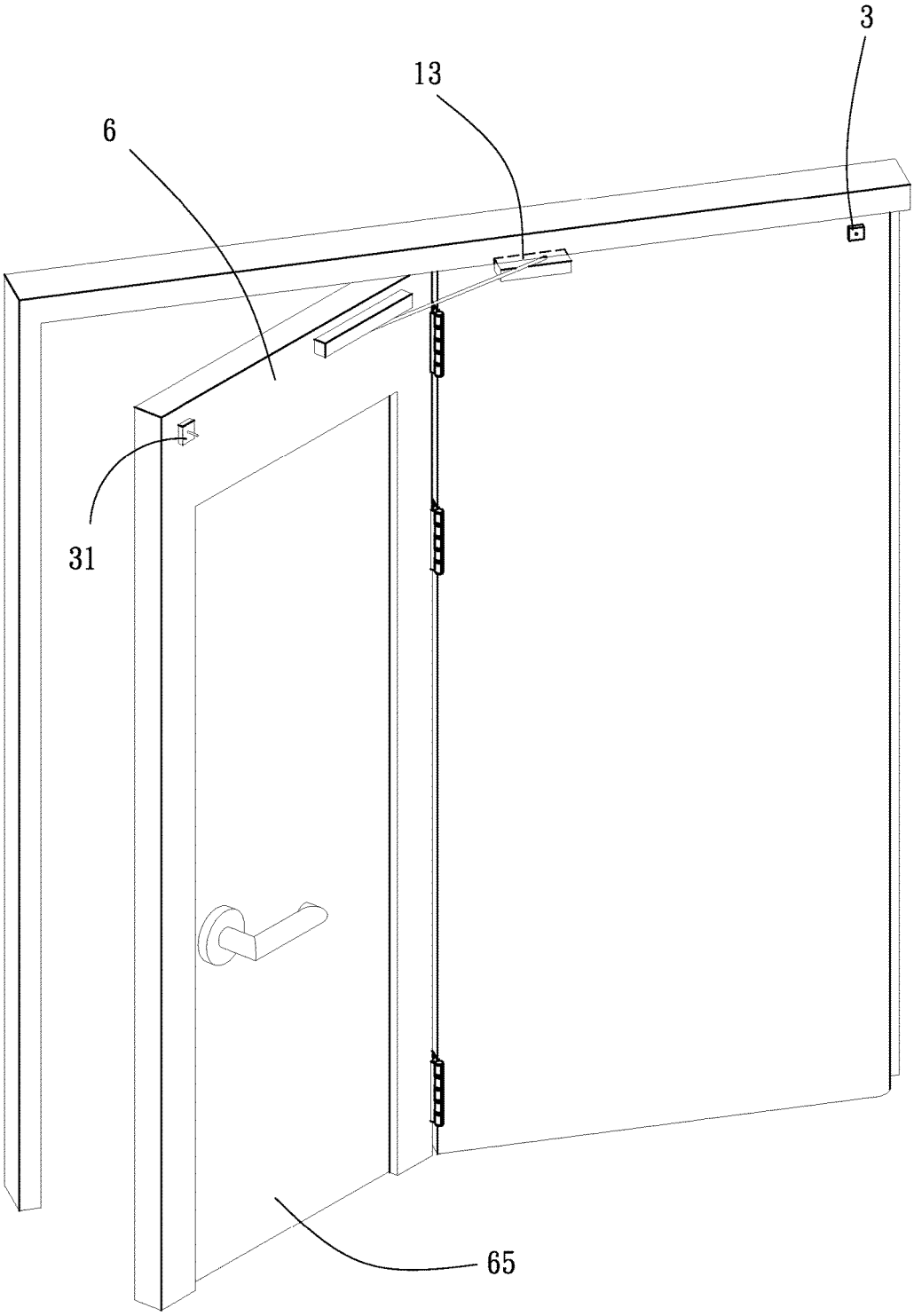
FIG. 7 is a schematic operational view of the present invention, illustrating a closing operation of the second door leaf.
Figure 8:
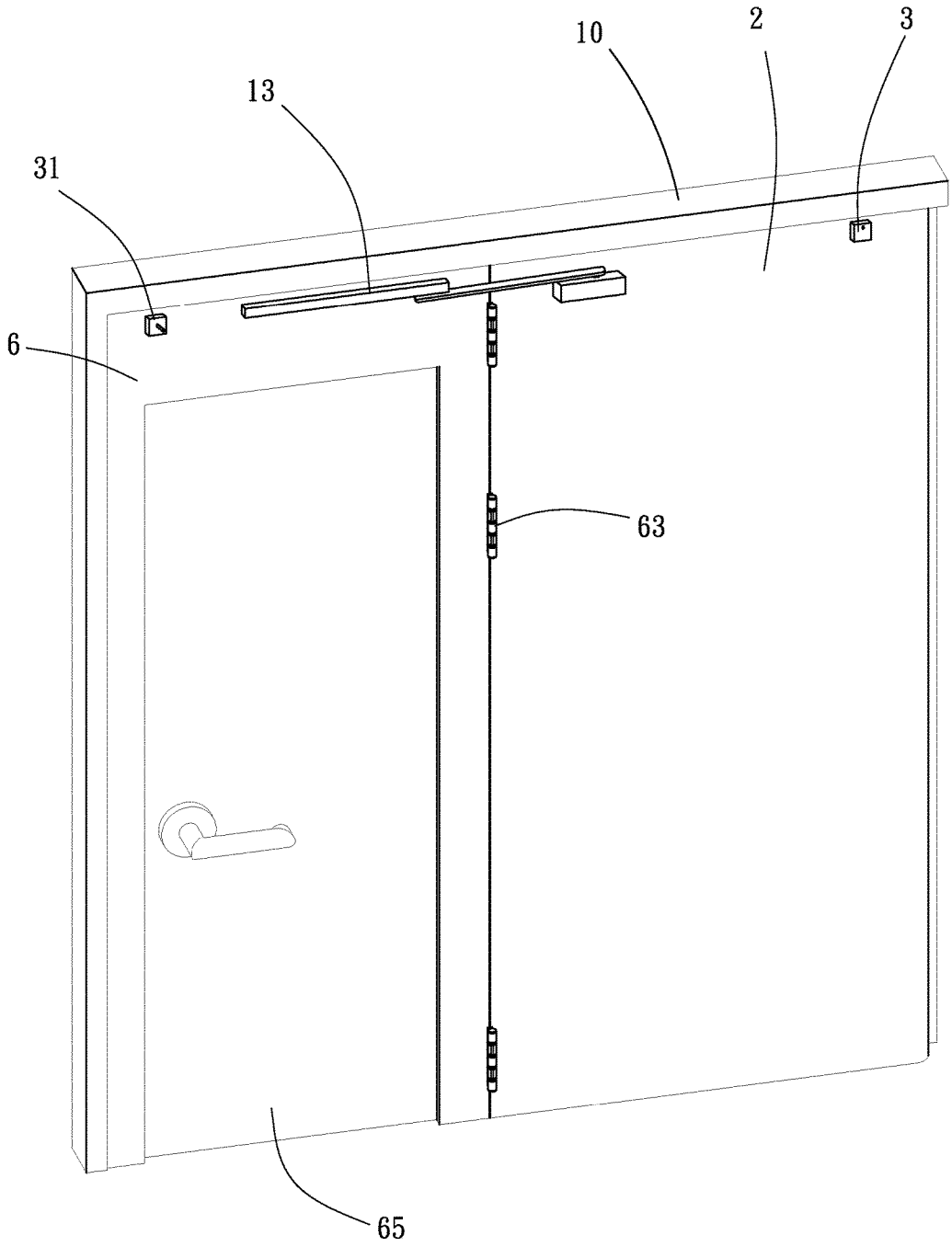
FIG. 8 corresponds to FIG. 7, illustrating the second door leaf completely closed.

Referring to FIGS. 3, 5 and 7, the first fixing device 3 comprises a lock hole 35, a control circuit (not shown), and a power supply (not shown). The control circuit, the power supply and the lock hole 35 are electrically coupled together. The second fixing device 31 is lockable to and releasable by the lock hole 35. The micro switch 30 can be triggered by the door frame 10 to provide an electric signal to the control circuit. Upon receipt of the electric signal from the micro switch 30, the control circuit drives the power supply to initiate the lock hole 35, thereby releasing the second fixing device 31. When the second fixing device 31 is unlocked, the second closing door device 13 automatically move the second door leaf 6 into the first door frame 10 in the close position.

When compared with conventional large width normally open door designs, the invention is more practical for use in an emergency shelter or a narrow walkway or space for the advantages of relatively smaller radius of gyration and amplitude, free personnel movement without hindering, and high reliability in large width access gate auto-closing performance.

When opening the second door leaf 6, the second door leaf 6 has a small radius of gyration and amplitude. Thus, when the Automatic released foldable door having two-way door structure of the present invention is used in an emergency shelter or a narrow walkway or space, it does not hinder the movement of people. Any person can press or pull the control knob 55 at the outer edge 25 of the first door leaf 2 to move the elastic latch rod 53 back into the inside of the mounting hole 22, allowing the second door leaf 6 with the first door leaf 2 to be reversed through 180° angle, so that the second door leaf 6 with the first hinge 4 and the first door leaf 2 can be received to the wall at one lateral side of the first door frame 10 where the third fixing device 7 is secured to the fourth fixing device 71 to lock the Automatic released foldable door having two-way door structure in the received position.

Further, the first door leaf 2 or the second door leaf 6 can be of a two-way design that can be closed or opened in either of two directions.

Figure 9:
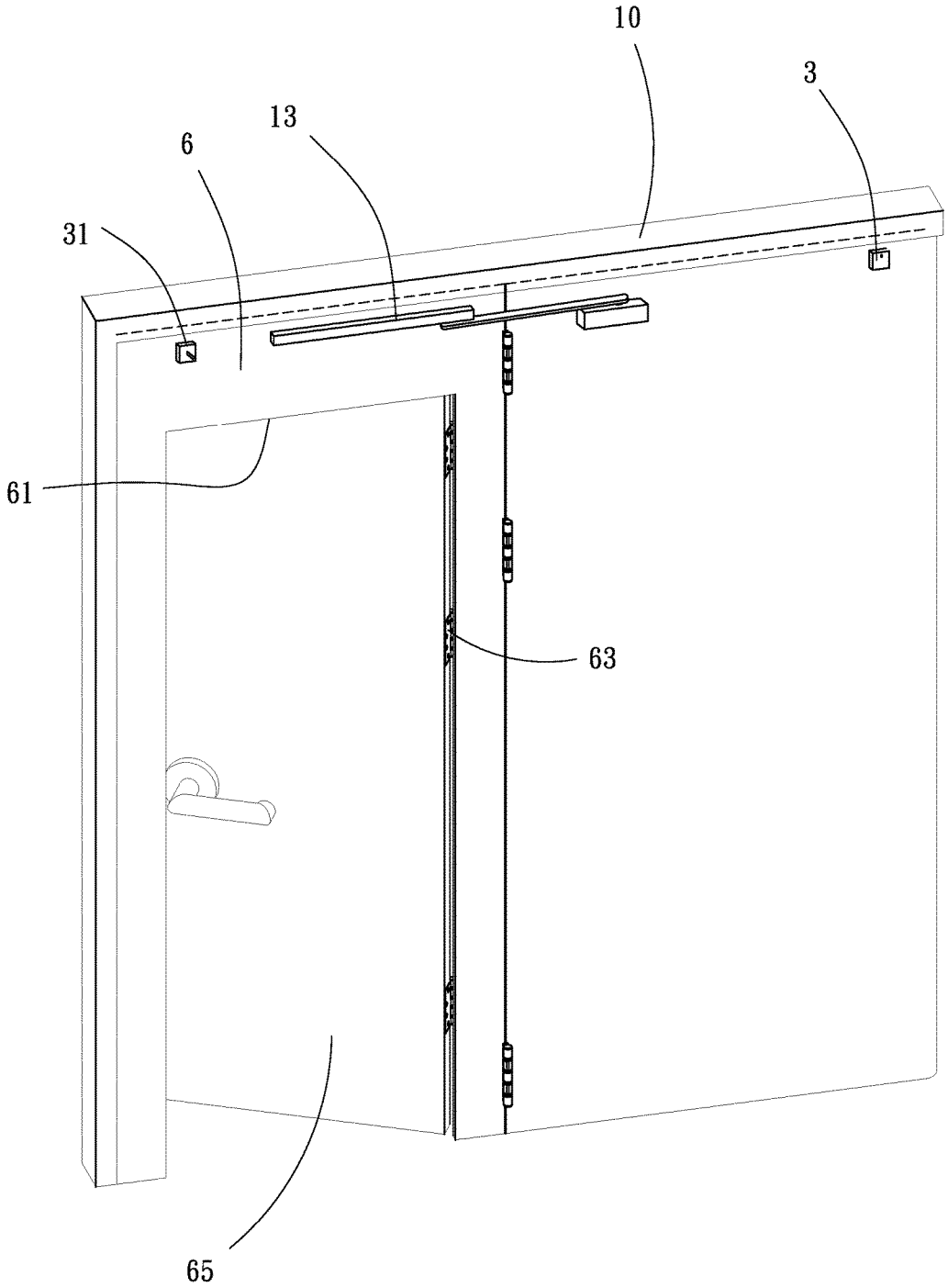
FIG. 9 corresponds to FIG. 8, illustrating the third door leaf opened from the second door frame at a first position.
Figure 10:
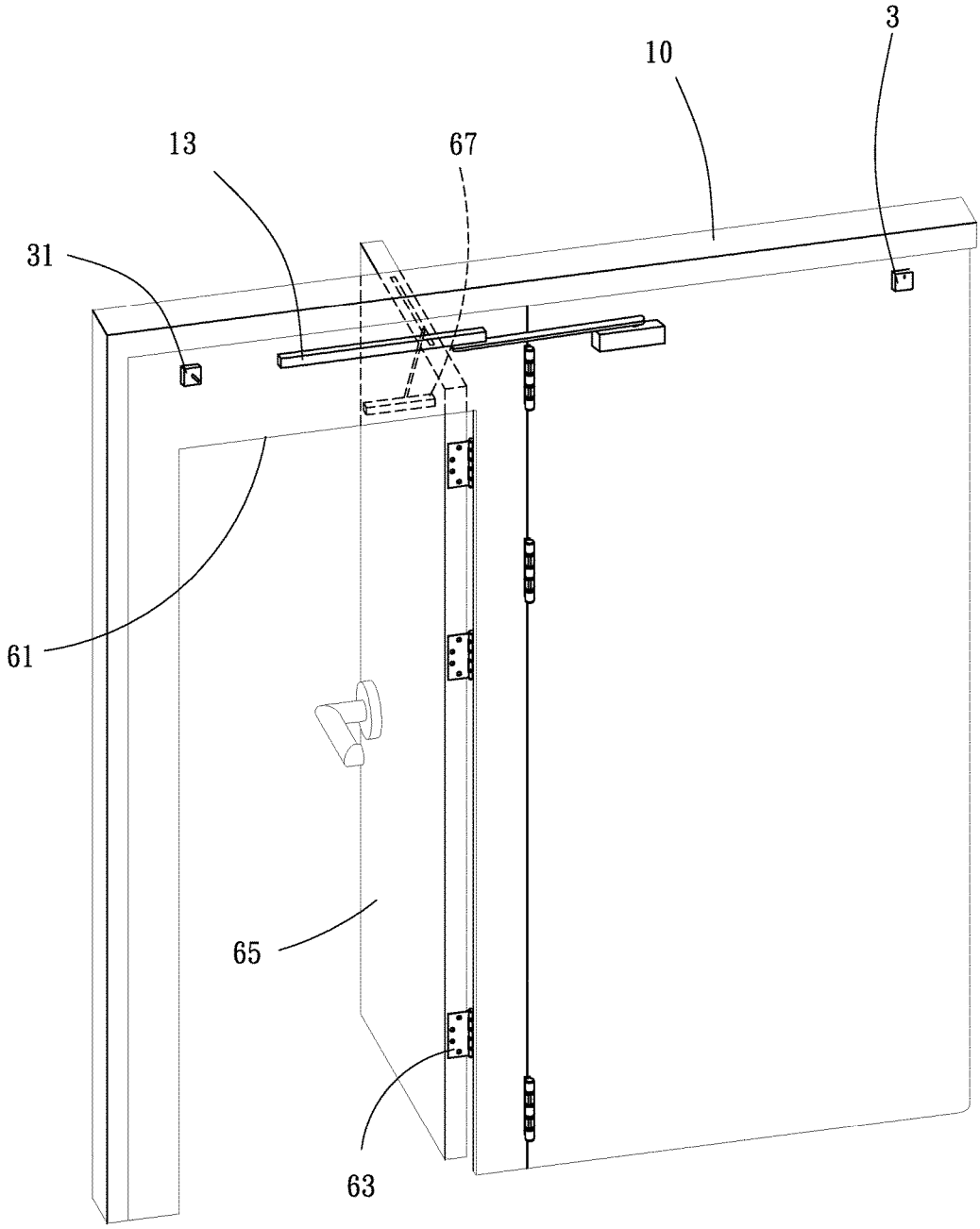
FIG. 10 corresponds to FIG. 8, illustrating the third door leaf opened from the second door frame at a second position.

Referring to FIGS. 9 and 10, the Automatic released foldable door having two-way door structure, the second door leaf 6 is a two-way door, comprising a second door frame 61, a second hinge 63, a third door leaf 65 and a third closing door means, i.e., third closing door device 67. The second door frame 61 is an open frame. The second hinge 63 has one hinge leaf thereof affixed to the second door frame 61, and an opposite hinge leaf thereof affixed to the third door leaf 65. The third closing door device 67 has one side there connected to a top edge of the second door frame 61, and an opposite side thereof connected to a top side of the third door leaf 65. After the second door leaf 6 (second door frame 61) is closed and locked to the first door frame 10, the user can open the third door leaf 65 relative to the first door frame 10 in the other direction in which the second door frame 61 cannot be moved. A user in the other side relative to the first door frame 10 can open the second door leaf 6 (including the third door leaf 65) in the opposite direction (see FIG. 6 and FIG. 7). The two-way folding door structure of the present invention allows the user to open the door in either of the two reversed directions. The invention utilizes the door-in-door structure design to form an entity gate with a small door disposed within a large door, allowing opening and closing of the door frame in a two-way manner. Thus, the invention provides a two-way door function openable to escape or closable to protect against fire in either of two reversed directions.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. An automatic released foldable door, comprising:

a first closing door means;

a first door leaf connected to one side of said first closing door means, said first door leaf comprising a top edge, an outer edge vertically downwardly extended from one end of said top edge and a mounting hole vertically downwardly extended from said top edge;

a first fixing device mounted at one side of said first door leaf;

a micro switch mounted at said top edge and electrically connected to said first fixing device;

a locking latch mounted in said mounting hole of said first door leaf;

a second door leaf;

a second fixing device mounted at one side of said second door leaf corresponding to said first fixing device and detachably connectable with said first fixing device;

a third fixing device mounted at another side of said second door leaf;

at least one first hinge having one hinge leaf thereof affixed to said first door leaf and another hinge leaf thereof affixed to said second door leaf; and a second closing door means having one end thereof connected to said first door leaf and another end thereof connected to said second door leaf, wherein said first fixing device comprises a lock hole, a control circuit and a power supply, said control circuit, said power supply and said lock hole being electrically coupled together, said second fixing device being lockable to and releasable by said lock hole subject to control of said control circuit.

2. The automatic released foldable door as claimed in claim 1, further comprising a first door frame wherein said first closing door means has one side connected to said first door frame.

3. The automatic released foldable door as claimed in claim 2, further comprising an electric control switch and a fourth fixing device, said fourth fixing device being mounted at a wall at one lateral side of said first door frame to face toward said third fixing device, said electric control switch being electrically coupled with said fourth fixing device and adapted for controlling said fourth fixing device to release said third fixing device.

4. The automatic released foldable door as claimed in claim 2, wherein a control knob is manually operable to retract an elastic latch rod into inside of said mounting hole, for allowing said first door leaf and said second door leaf to be folded up and received to a surrounding wall at one lateral side of said first door leaf where said third fixing device is locked to a fourth fixing device.

5. The automatic released foldable door as claimed in claim 4, wherein one of said first door leaf and said second door leaf is a two-way door design.

6. The automatic released foldable door as claimed in claim 5, wherein said second door leaf comprises a second door frame, a second hinge, a third door leaf and a third closing door means, said second hinge having one hinge leaf thereof affixed to said second door frame and another hinge leaf thereof affixed to said third door leaf, said third closing door means having one side thereof connected to a top edge of said second door frame and another side thereof connected to a top side of said third door leaf, said third door leaf being openable relative to said first door frame when said second door leaf is closed and locked to said first door frame.

7. The automatic released foldable door as claimed in claim 1, wherein said first closing door means or said second closing door means or is a closing door device that automatically closes a connected door leaf after the connected door leaf has been opened by a person.

8. An automatic released foldable door, comprising:

a first closing door means;

a first door leaf connected to one side of said first closing door means, said first door leaf comprising a top edge, an outer edge vertically downwardly extended from one end of said top edge and a mounting hole vertically downwardly extended from said top edge;

a first fixing device mounted at one side of said first door leaf;

a micro switch mounted at said top edge and electrically connected to said first fixing device;

a locking latch mounted in said mounting hole of said first door leaf;

a second door leaf;

a second fixing device mounted at one side of said second door leaf corresponding to said first fixing device and detachably connectable with said first fixing device;

a third fixing device mounted at another side of said second door leaf;

at least one first hinge having a first hinge leaf thereof affixed to said first door leaf and a second hinge leaf thereof affixed to said second door leaf; and a second closing door means having one end thereof connected to said first door leaf and another end thereof connected to said second door leaf, wherein said locking latch comprises a touch pressure device, an elastic latch rod and a control knob, said touch pressure device comprising a receiving hole, said control knob being mounted at said outer edge of said first door leaf, said elastic latch rod being inserted into said mounting hole with one end thereof movable in and out of said receiving hole of said touch pressure device, said touch pressure device being mounted in a top side of said mounting hole to release said elastic latch rod for allowing said elastic latch rod to extend the said one end of said elastic latch rod out of said mounting hole, said control knob being operable by an external force to move said elastic latch rod into a retracted position where the said one end of said elastic latch rod is received inside said mounting hole.

9. The automatic released foldable door as claimed in claim 8, further comprising a first door frame wherein said first closing door means has one side connected to said first door frame.

10. The automatic released foldable door as claimed in claim 9, further comprising an electric control switch and a fourth fixing device, said fourth fixing device being mounted at a wall at one lateral side of said first door frame to face toward said third fixing device, said electric control switch being electrically coupled with said fourth fixing device and adapted for controlling said fourth fixing device to release said third fixing device.

11. The automatic released foldable door as claimed in claim 9, wherein said control knob is manually operable to retract said elastic latch rod into inside of said mounting hole, for allowing said first door leaf and said second door leaf to be folded up and received to a surrounding wall at one lateral side of said first door leaf where said third fixing device is locked to a fourth fixing device.

12. The automatic released foldable door as claimed in claim 11, wherein one of said first door leaf and said second door leaf is a two-way door design.

13. The automatic released foldable door as claimed in claim 12, wherein said second door leaf comprises a second door frame, a second hinge, a third door leaf and a third closing door means, said second hinge having one hinge leaf thereof affixed to said second door frame and another hinge leaf thereof affixed to said third door leaf, said third closing door means having one side thereof connected to a top edge of said second door frame and another thereof connected to a top side of said third door leaf, said third door leaf being openable relative to said first door frame when said second door leaf is closed and locked to said first door frame.

* * * * *